US007679584B2

(12) United States Patent
Jeon

(10) Patent No.: US 7,679,584 B2
(45) Date of Patent: Mar. 16, 2010

(54) ELECTRON EMISSION DISPLAY (EED) WITH SEPARATED GROUNDS

(75) Inventor: Dong-Hyup Jeon, Suwon-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 1035 days.

(21) Appl. No.: 11/111,840

(22) Filed: Apr. 22, 2005

(65) Prior Publication Data

US 2005/0253830 A1 Nov. 17, 2005

(30) Foreign Application Priority Data

Apr. 29, 2004 (KR) ..... 10-2004-0030007

(51) Int. Cl.
*G09G 3/22* (2006.01)

(52) U.S. Cl. ..... 345/75.2; 345/75.1; 345/211

(58) Field of Classification Search ..... 345/10–30, 345/74.1, 75.1, 75.2, 211
See application file for complete search history.

(56) References Cited

U.S. PATENT DOCUMENTS 4,622,627 A 11/1986 Rodriguez et al.
5,068,631 A * 11/1991 Vince ..... 333/181
5,724,519 A * 3/1998 Kato et al. ..... 345/204
5,781,386 A * 7/1998 Muelleman ..... 361/43

FOREIGN PATENT DOCUMENTS

| | | |
|---|---|---|
| CN | 1423349 | 6/2003 |
| JP | 10-200915 | 7/1998 |
| JP | 2000-340991 | 12/2000 |
| JP | 2003-069169 | 3/2003 |
| JP | 2004-111053 | 4/2004 |

OTHER PUBLICATIONS

*Office Action* from the Chinese Patent Office issued in Applicant's corresponding Chinese Patent Application No. 2005-10076240.0 dated Dec. 7, 2007.
Chinese "Certification of Patent for Invention" Cert. No. 516285 issued on Jul. 1, 2009 for Applicant's corresponding Chinese Patent Application No. 200510076240.0. With English translation of Certificate abstract.

* cited by examiner

*Primary Examiner*—Duc Q Dinh
(74) *Attorney, Agent, or Firm*—Robert E. Bushnell, Esq.

(57) ABSTRACT

An EED capable of reducing noise influence between a high voltage element and a low voltage logic element in an EED panel includes: a high voltage ground for a high voltage element, a low voltage ground for a low voltage element, and a ferrite bead, connected between the high voltage ground and the low voltage ground, to block RF noise from the high voltage ground.

17 Claims, 7 Drawing Sheets

ELECTRON EMISSION DISPLAY (EED) WITH SEPARATED GROUNDS

CLAIM OF PRIORITY

This application makes reference to, incorporates the same herein, and claims all benefits accruing under 35 U.S.C. §119 from an application for ELECTRON EMISSION DISPLAY WITH SEPARATED GROUNDS earlier filed in the Korean Intellectual Property Office on Apr. 29, 2004 and there duly assigned Serial No. 10-2004-0030007.

BACKGROUND OF THE INVENTION

1. Field of the Invention

The present invention relates to an Electron Emission Display (EED), and more particularly, to an EED which can reduce noise influence transferred through a ground between a high voltage element and a low voltage element.

2. Description of the Related Art

An Electron Emission Display (EED) includes an EED panel and a driver. When the driver supplies a positive voltage to an anode of the EED panel, if a positive voltage is supplied to a gate electrode and a negative voltage is supplied to a cathode electrode, electrons are emitted from the cathode. The emitted electrons are accelerated toward the gate electrode and converged into the anode. Then, the electrons collide with fluorescent cells disposed in front of the anode, thereby emitting light.

The driver includes a video processor to convert an external analog video signal into a digital signal, a panel controller to generate driving control signals according to the internal video signal, a data driver and a scan driver to process the driving control signals and to output the processed control signals to electrode lines of the EED panel. The electrode lines include cathode electrode lines and gate electrode lines, which receive RF high voltage from the data driver and the scan driver, and an anode connected to a high voltage power supply.

Voltages supplied to the cathode electrode lines, the gate electrode lines and the anode are very high compared with those supplied to logic circuits of the drivers. Therefore, when a high voltage element and a low voltage element make use of a common ground, RF noise generated by the high voltage element is transferred to the low voltage element through the ground, causing an error in the low voltage element, for example, a logic circuit.

Also, the cathode electrode lines, the gate electrode lines and the anode are supplied with different high voltages rather than equal high voltages. Thus, RF noise has a bad influence upon them mutually. Specifically, as a frequency of a high voltage pulse supplied to the drivers increases, RF noise increases as much. In a large-size panel, data signals and scan signals must be supplied to more pixels with respect to the same horizontal and vertical synchronization signals. Thus, the frequency inevitably becomes higher. As the panel becomes larger in size, it needs to be designed considering the noise.

Furthermore, when a digital logic element and an analog logic element operate at a high frequency, the low voltage elements (logic elements) can also be mutually influenced by RF noise. Thus, noise reduction is necessary between the digital logic element and the analog logic element.

In an EED, low voltage elements (logic elements) and high voltage elements are commonly grounded. One side of the EED includes a substrate on which high voltage elements and low voltage elements are mounted together, and another side includes a high voltage element.

The low voltage logic element includes digital logic elements and analog logic elements and usually operates with ±5 V. As to the high voltage elements, a high voltage of ±50-100 V is supplied to a gate electrode line or data electrode line of the EED panel. A high voltage of about 4000 V is supplied to an anode. As to the digital logic elements, the driver is supplied with a high voltage in order to control a high voltage, which is supplied to the data electrode lines and scan electrode lines of the panel.

Therefore, the logic circuits, such as the driver for controlling the high voltage, are low voltage elements on the one hand, but are high voltage elements on the other hand. Since the high voltage elements are driven at an RF high voltage, noise occurs therein. The noise influences the low voltage elements through the ground.

For example, noise occurring in the anode having an electrical potential of 4 kV can influence the digital logic element and the analog logic element through the ground. Also, RF noise occurring in the high voltage element can influence other digital logic elements through the ground. Thus, the EED has a problem in that the picture quality of the images displayed on the EED panel is degraded.

SUMMARY OF THE INVENTION

The present invention provides an EED which is capable of reducing noise influence transferred between a high voltage element and a low voltage element through a ground.

Also, the present invention provides an EED which is capable of reducing noise influence by indirectly separating grounds for high voltage elements.

Furthermore, the present invention provides an EED, in which a digital logic element and an analog logic element use individual power sources and a common ground, and noise influence is reduced by a p-type noise reduction circuit.

According to the present invention, an Electron Emission Display (EED) comprises: a high voltage ground for a high voltage element; a low voltage ground for a low voltage element; and a ferrite bead, connected between the high voltage ground and the low voltage ground, to block RF noise from the high voltage ground.

The EED preferably further comprises: a plurality of high voltage grounds respectively for a plurality of high voltage elements driven by different high voltages; and a plurality of ferrite beads respectively connected between the plurality of high voltage grounds.

At least one of the plurality of high voltage grounds is preferably connected to an anode of an EED panel.

At least one of the plurality of high voltage grounds is alternatively preferably connected to cathode electrode lines of an EED panel.

At least one of the plurality of high voltage grounds is alternatively preferably connected to gate electrode lines of an EED panel.

The low voltage ground is preferably connected to a data driver adapted to output a data signal to an EED panel.

The low voltage ground is alternatively preferably connected to a scan driver adapted to output a scan signal to an EED panel.

The low voltage ground is alternatively preferably commonly connected to a digital logic power source for a digital logic element and an analog logic power source for an analog logic element, and a ferrite bead is connected between the digital logic power source and the analog logic power source to mutually block noise from each other.

The EED preferably further comprises capacitors respectively connected between the digital logic power source and the low voltage ground and between the analog logic power source and the low voltage ground, the ferrite bead and the capacitors adapted to function as a π-type noise reduction circuit.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
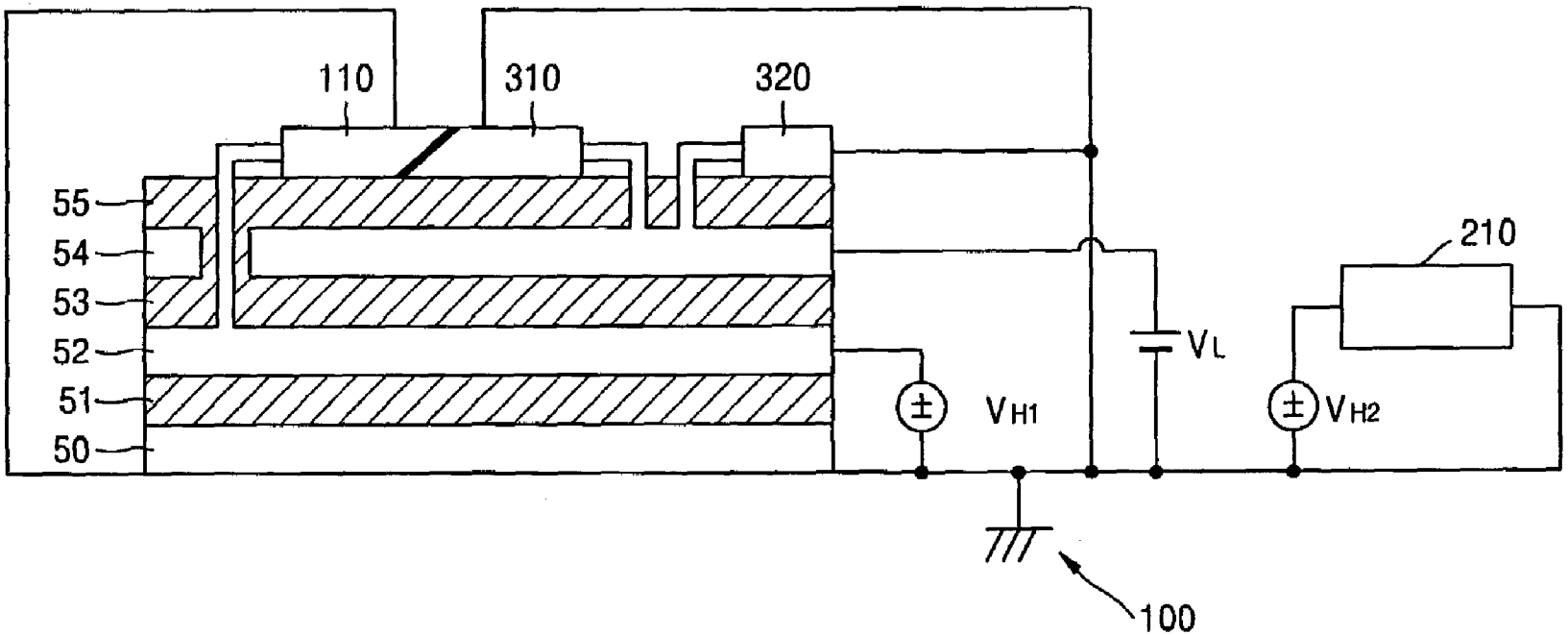
FIG. 1 is a schematic diagram of low voltage elements (logic elements) and high voltage elements, which are commonly grounded in an EED.

FIG. 1 is a schematic diagram illustrating low voltage elements (logic elements) and high voltage elements, which are commonly grounded in an EED. In FIG. 1, a left side includes a substrate on which high voltage elements 110 and low voltage elements 310 and 320 are mounted together, and a right side includes a high voltage element 210.

The low voltage logic element includes digital logic elements 310 and analog logic elements 320 and usually operates with ±5 V. As to the high voltage elements 210, a high voltage $V_{H2}$ of ±50-100 V is supplied to a gate electrode line or data electrode line of the EED panel. A high voltage of about 4000 V is supplied to an anode. As to the digital logic elements 310, the driver is supplied with a high voltage $V_{H1}$ in order to control a high voltage, which is supplied to the data electrode lines and scan electrode lines of the panel.

Therefore, the logic circuits, such as the driver for controlling the high voltage $V_{H1}$, are low voltage elements on the one hand, but are high voltage elements on the other hand. Since the high voltage elements 110 and 210 are driven at an RF high voltage, noise occurs therein. The noise influences the low voltage elements 310 and 320 through the ground.

For example, noise occurring in the high voltage element 210 having an electrical potential of 4 kV can influence the digital logic element 310 and the analog logic element 320 through the ground. Also, RF noise occurring in the high voltage element 110 can influence other digital logic elements through the ground. Thus, the EED has a problem in that the picture quality of the images displayed on the EED panel is degraded.

The present invention will now be described more fully with reference to the accompanying drawings, in which exemplary embodiments of the present invention are shown.

Figure 2:
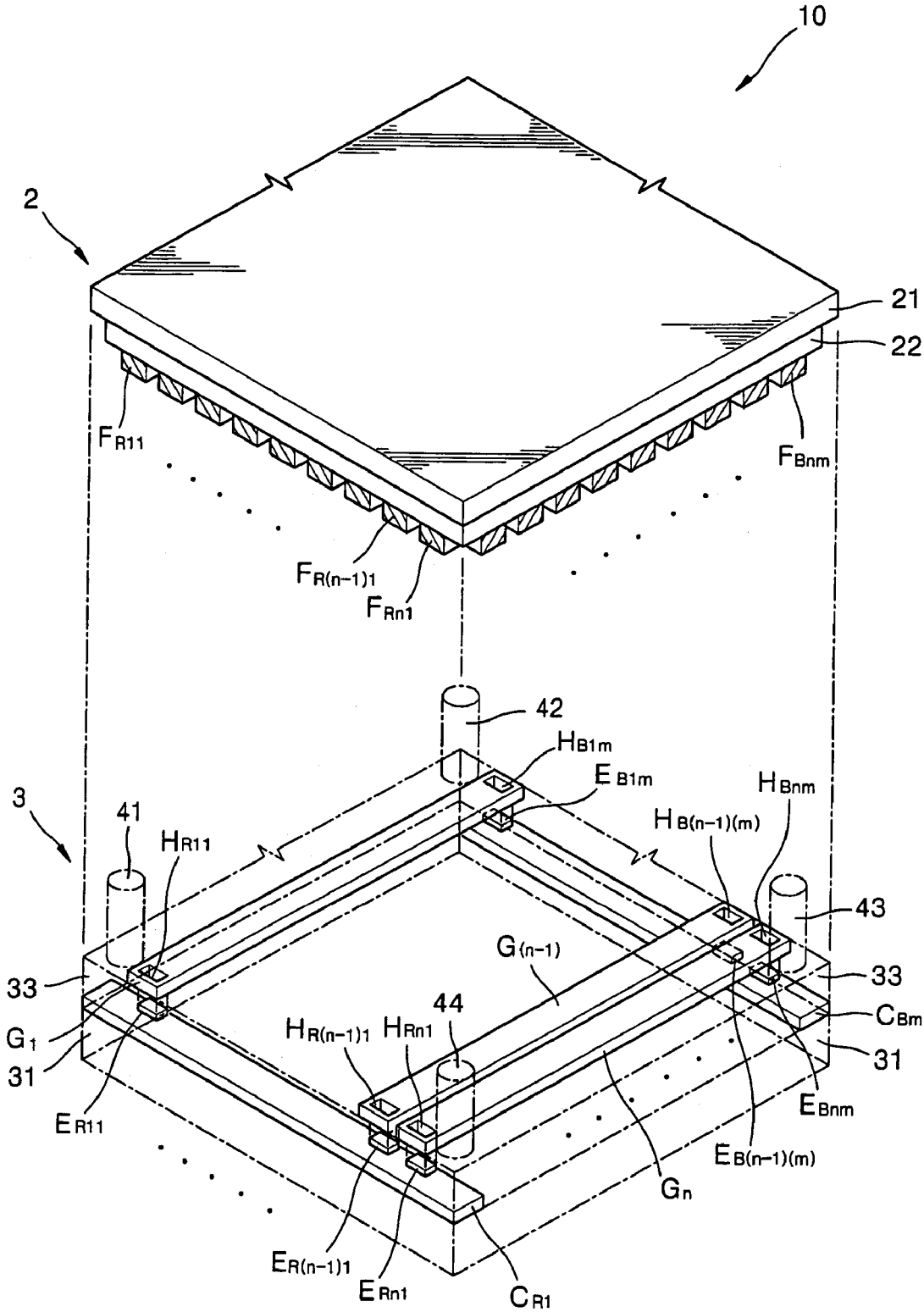
FIG. 2 is an exploded perspective view of an EED panel in an EED according to an embodiment of the present invention.

FIG. 2 is an exploded perspective view of an EED panel in an EED according to an embodiment of the present invention.

Referring to FIG. 2, an EED panel 1 includes a front panel 2 and a rear panel 3, which are supported by space bars 41 to 43.

The rear panel 3 includes a rear substrate 31, cathode electrode lines $C_{R1}$ to $C_{Bm}$, electron emitting sources $E_{R11}$ to $E_{Bnm}$, an insulating layer 33, and gate electrode lines $G_1$ to $G_n$.

Data signals are supplied to the cathode electrode lines $C_{R1}$ to $C_{Bm}$. The cathode electrode lines $C_{R1}$ to $C_{Bm}$ are electrically connected to the electron emitting sources $E_{R11}$ to $E_{Bnm}$. Through-holes $H_{R11}$ to $H_{Bnm}$ corresponding to the electron emitting sources $E_{R11}$ to $E_{Bnm}$ are formed in a first insulating layer 33 and the gate electrode lines $G_1$ to $G_n$. In the gate electrode lines $G_1$ to $G_n$, the through-holes $H_{R11}$ to $H_{Bnm}$ are formed at locations where the cathode electrode lines $C_{R1}$ to $C_{Bm}$ intersect with the gate electrode lines.

The front panel 2 includes a front transparent substrate 21, an anode 22, and fluorescent cells $F_{R11}$ to $F_{Bnm}$. A high positive electrical potential of 1-4 KV is supplied to the anode 22, allowing the electrons to move from the electron emitting sources $E_{R11}$ to $E_{Bnm}$ to the fluorescent cells.

Figure 3:
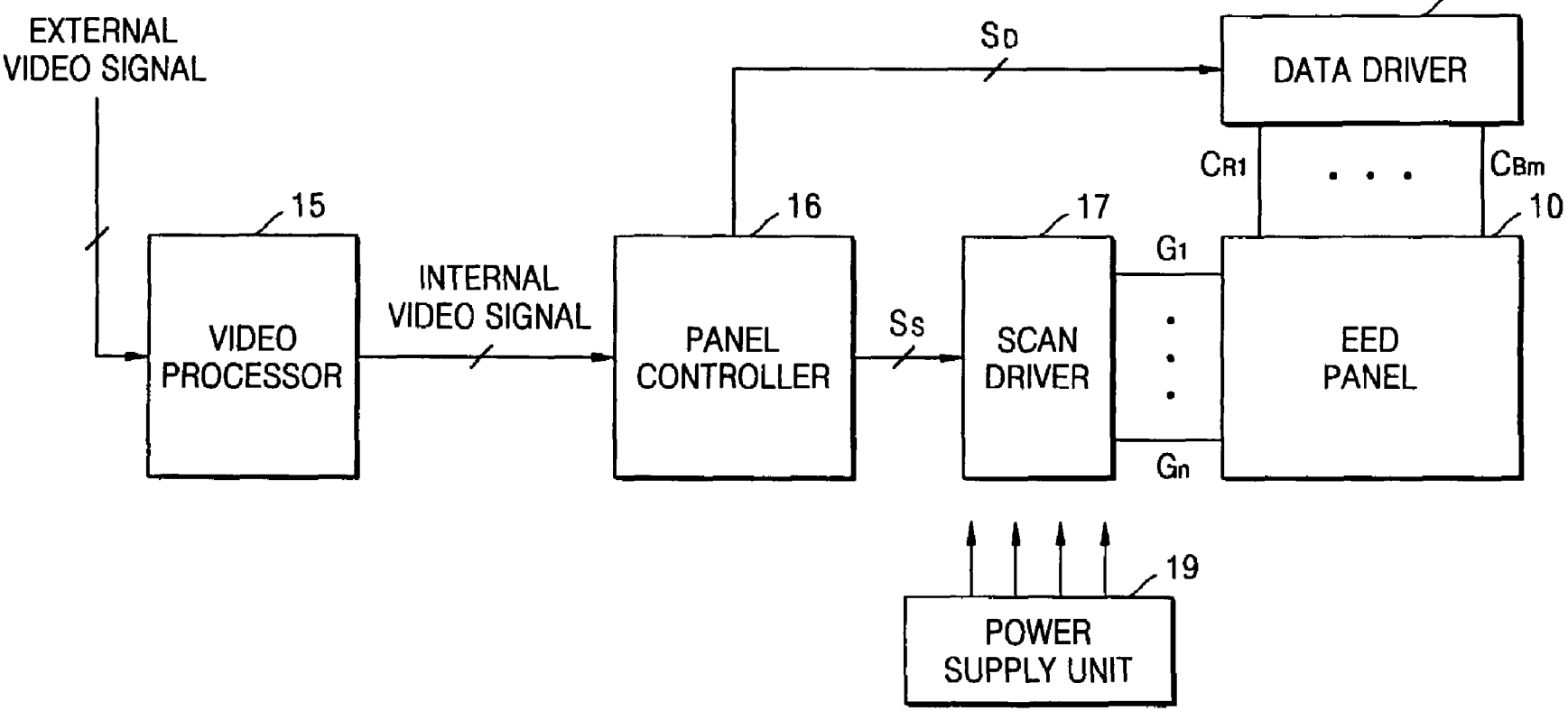
FIG. 3 is a block diagram of an EED according to an embodiment of the present invention.

FIG. 3 is a block diagram of the EED according to an embodiment of the present invention.

The EED includes the EED panel 10 and a driver. The driver for the EED panel 10 includes a video processor 15, a panel controller 16, a scan driver 17, a data driver 18, and a power supply unit 19.

The video processor 15 converts an external analog video signal into a digital video signal and outputs the digital video signal as an internal video signal. The external analog video signal includes video signals from computers, DVD players and TV set-top boxes, and the internal video signal includes 8-bit R, G and B video data, a clock signal, and horizontal and vertical synchronization signals.

The panel controller 16 generates data driving control signals SD and scan driving control signals SS according to the internal video signal outputted from the video processor 15. The data driver 18 processes the data driving control signals SD and outputs display data signals to data electrode lines $C_{R1}$ to $C_{Bm}$ of the EED panel 10. The scan driver 17 processes the scan driving control signals SS and outputs the processed signals to scan electrode lines $G_1$ to $G_n$.

The power supply unit 19 supplies electrical potentials of 1-4 KV to the video processor 15, the panel controller 16, the scan driver 17, the data driver 18, and the anode of the EED panel 10.

Figure 4:
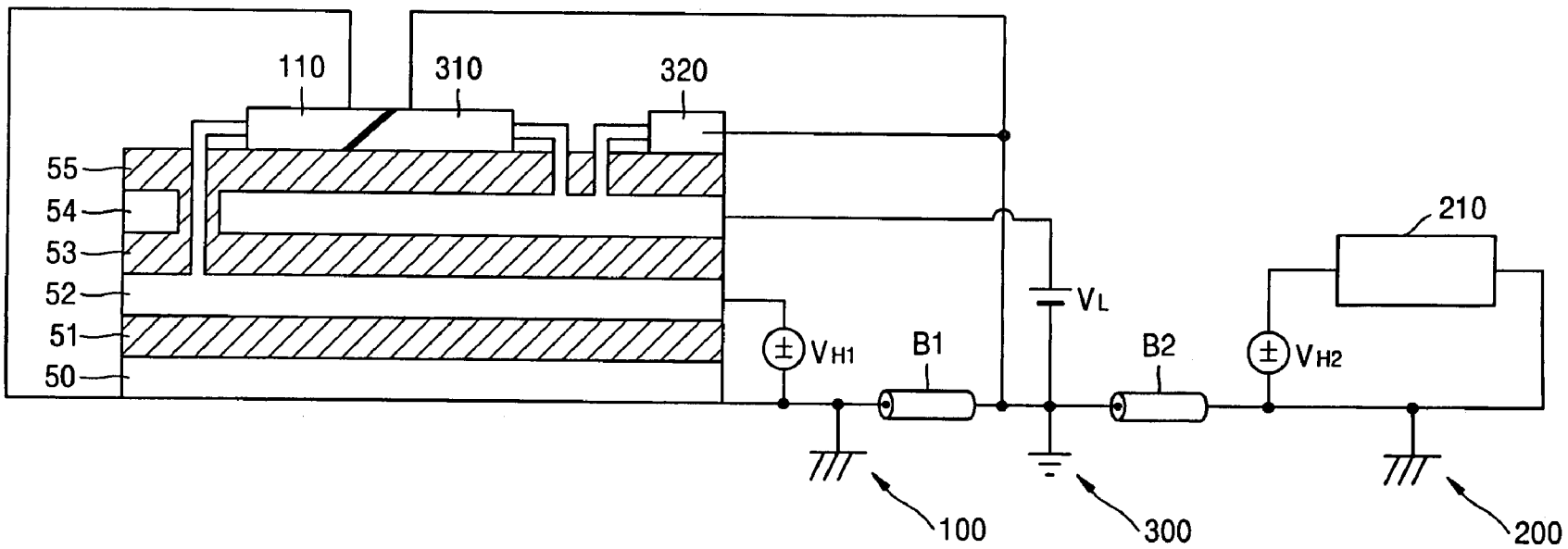
FIG. 4 is a schematic diagram of low voltage elements (logic elements) and high voltage elements, which are commonly grounded in an EED according to an embodiment of the present invention.

FIG. 4 is a schematic diagram of low voltage elements (logic elements) and high voltage elements, which are commonly grounded in an EED according to an embodiment of the present invention.

Referring to FIG. 4, a left side includes low voltage elements 310 and 320 arranged on a substrate 51, and a right side includes a high voltage element 210. A ground layer 50, a layer 52 for supplying a first voltage $V_{H1}$, a first insulating layer 53, a layer 54 for supplying a logic low voltage VL, and a second insulating layer 55 are arranged on the left side of the substrate 51. The low voltage analog element 320 and the low voltage digital element 310 are connected to the logic low voltage (VL) layer, and the high voltage element 110 is connected to the layer 52 for supplying the first voltage $V_{H1}$. In one embodiment, the elements 110 and 310 are low voltage analog elements and also are the high voltage elements. For example, while the data driver 18 or the scan driver 17 for controlling high voltage pulses is operated by the digital logic power source VL, it is supplied with high voltage $V_{H1}$, the so-called Vpp, and outputs a high voltage pulse.

The right high voltage element 210 can be one of the anode 22, the gate electrode lines $G_1$ to $G_n$, and the cathode electrode lines $C_{R1}$ to $C_{Bm}$. In this embodiment, the high voltage element 210 supplied with the right high voltage $V_{H2}$ is the anode 22 and will be referred to as a second high voltage element 210. Also, the high voltage element 110 supplied with the left high voltage $V_{H1}$ is the data driver 18 and will be referred to as a first high voltage element 110.

Since the integrated circuits, such as the scan driver 17 or the data driver 18 among the low voltage elements, which supply high pulse voltages to the panel 10, must be supplied with the high voltage $V_{H1}$, they also act as the high voltage element 110.

The first high voltage $V_{H1}$ is supplied to the first high voltage element 110, and the second high voltage $V_{H2}$ is supplied to the second high voltage element 210. Both the low voltage analog element 320 and the low voltage digital element 310 operate with the low voltage $V_L$.

The data driver that is the first high element 110 operates with high voltage pulses having a frequency of more than (the number of frames)×(the number of vertical pixels) at a voltage of ±50-100 V, resulting in strong noise. Such noise can flow into other nodes through the ground. However, the ground 100 of the first high voltage element 110 is separated from the ground 300 of the low voltage element 310 and 320 by a ferrite bead B1. Therefore, RF noise does not influence the low voltage logic element 320 through the ground 100.

The high voltage $V_{H2}$ of 4000 V is supplied to the anode 22 that is the second high voltage element 210, and the high voltage $V_{H2}$ and the second high voltage element 210 causes noise that temporarily causes the ground 300 to be at a predetermined non-zero electrical potential. Such noise cannot be fully eliminated. Noise that changes the ground potential 300 due to the high voltage ($V_{H2}$) power source and the second high voltage element 210 can influence the low voltage elements 310 and 320. However, the ground 200 for the high voltage and the ground 300 for the low voltage $V_L$ are separated from each other with respect to only RF noise by a ferrite bead B2, thereby blocking the noise influence from the ground 200 for the high voltage.

The low voltage logic element includes the digital logic elements 310 and the analog logic elements 320 and typically operates with ±5V. Among the high voltage elements 210, the high voltage $V_{H2}$ of ±50-100 V is supplied to a gate electrode line or data electrode line of the panel. A high voltage of about 4000 V is supplied to the anode. As to the digital logic elements 310, the data driver 18 and the scan driver 17 are supplied with a high voltage $V_H$ in order to control a high voltage, which is supplied to the cathode electrode lines and gate electrode lines of the panel. Therefore, the logic circuits, such as the scan driver 17 and the data driver 18 which control the high voltage $V_{H1}$, are the high voltage element 110 on the one hand, but are also the low voltage element 310 on the other hand. Since the high voltage elements 110 and 210 are driven at the high voltage, noise can occur and influence the low voltage elements 310 and 320 by changing the electrical potential of the ground 100. However, according to the EED of the present invention, the ground 300 is separated with respect to noise by the ferrite beads B1 and B2, so that there is no influence of noise.

Figure 5:
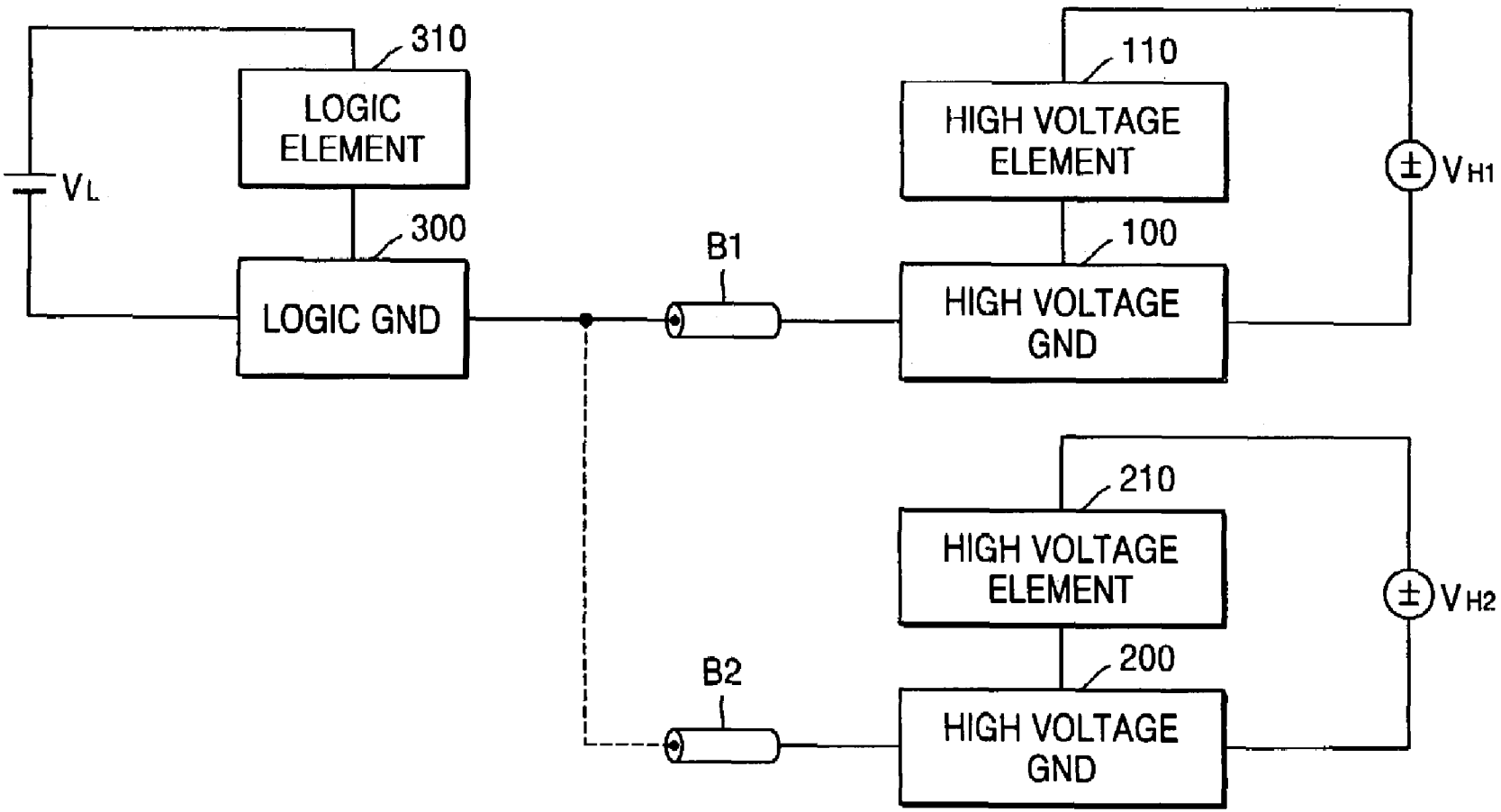
FIG. 5 is a circuit diagram of high voltage grounds and low voltage grounds, which are separated by ferrite beads in an EED according to the present invention.

FIG. 5 is a circuit diagram of the grounds for the high voltage element and the grounds for the low voltage element, which are separated by the ferrite beads in the EED according to the present invention. The low-voltage ground 300, the first high voltage ground 100, and the second high voltage ground 200 are separately provided, and the ferrite beads B1 and B2 are interconnected among the grounds 100, 200 and 300 in order to make the ground potential identical to one another.

In one embodiment, if the first high voltage element 110 is the data driver 18, it generates a pulse of −70 V and the high voltage pulse causes noise that has an influence on the electrical potential of the first high voltage ground 100. Also, the second high voltage element 210, (the anode 22) is supplied with a voltage of 1 V to 4000 V and causes noise that has an influence on the second high voltage ground 200. The ferrite beads B1 and B2 reduce a noise influence between the first high voltage ground 100 and the second high voltage ground 200 and also among the first and second high voltage grounds 100 and 200 and the low voltage ground 300.

Figure 6:
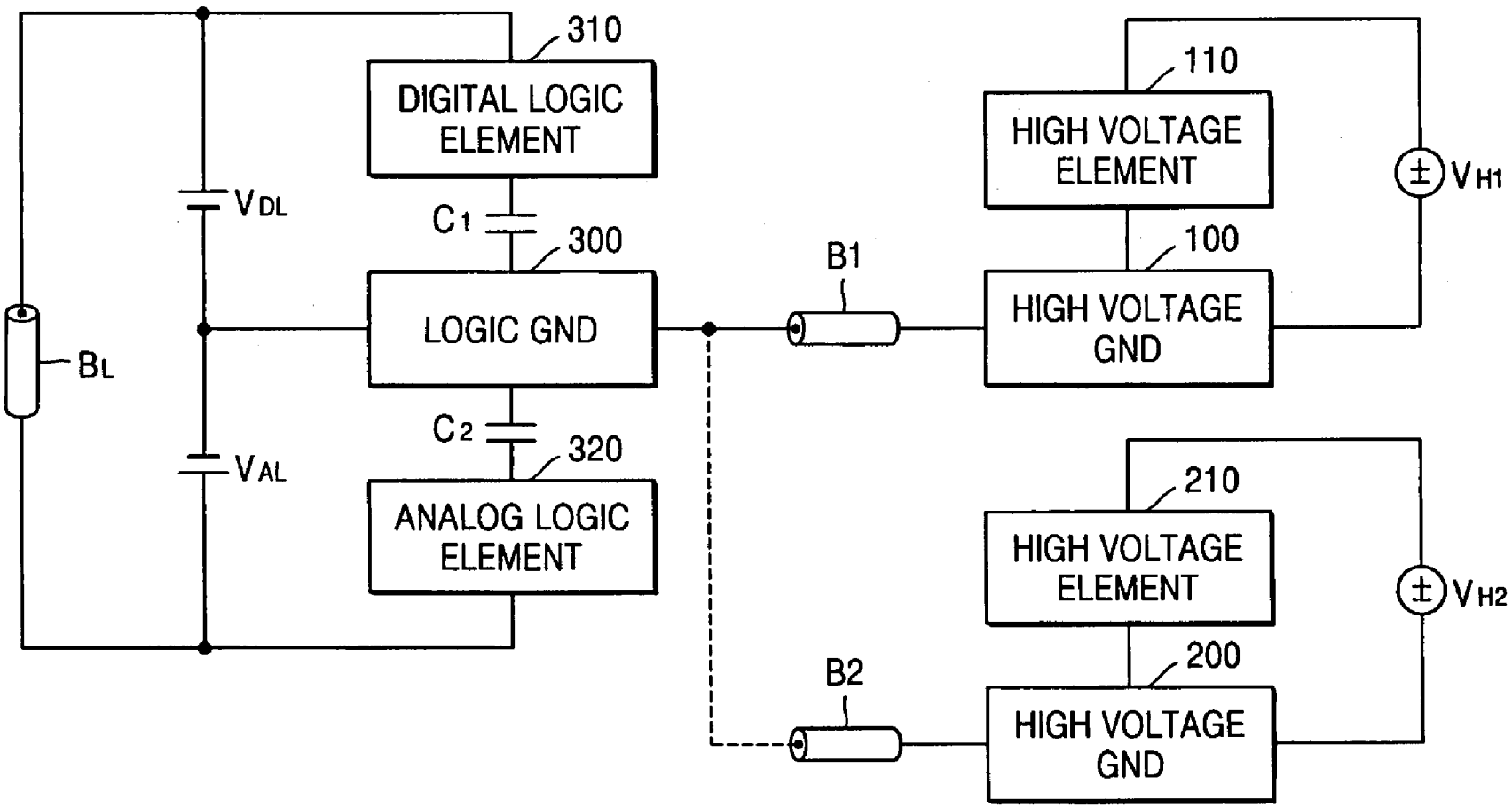
FIG. 6 is a circuit diagram of a noise reduction filter for a low voltage logic element in the circuit of FIG. 5.

FIG. 6 is a circuit diagram of a noise reduction filter for the low voltage logic element in the circuit of FIG. 5.

Referring to FIG. 6, the low voltage logic element is divided into a digital logic element 310 and an analog logic element 320. Power sources for them are individually provided. Furthermore, the ferrite bead $B_L$ and a capacitor are provided. A low voltage ground 300 for the logic element is commonly connected to a digital logic power source $V_{DL}$ for the digital logic element 310 and an analog logic power source $V_{AL}$ for the analog logic element 320. The ferrite bead $B_L$ is interconnected between the digital logic power source $V_{DL}$ and the analog logic power source $V_{AL}$ in order to block noise therebetween. For example, when the digital logic element 310 uses an RF pulse and the analog logic element 320 performs an RF switching operation, noise occurs that can have a bad influence on them. The ferrite bead $B_L$ functions to block RF noise in order to prevent the analog logic element 320 from being influenced by the noise occurring in the digital logic element 310. Also, the ferrite bead $B_L$ functions to block RF noise in order to prevent the digital logic element 310 from being influenced by the noise occurring in the analog logic element 320.

A capacitor C1 is connected between the digital logic power source $V_{DL}$ and the low voltage ground 300, and a capacitor C2 is connected between the analog logic power source $V_{AL}$ and the low voltage ground 300. If the ferrite bead $B_L$ is considered to be an inductor, the low power elements 310 and 320 are protected from noise by a p-type noise reduction circuit.

Figure 7:
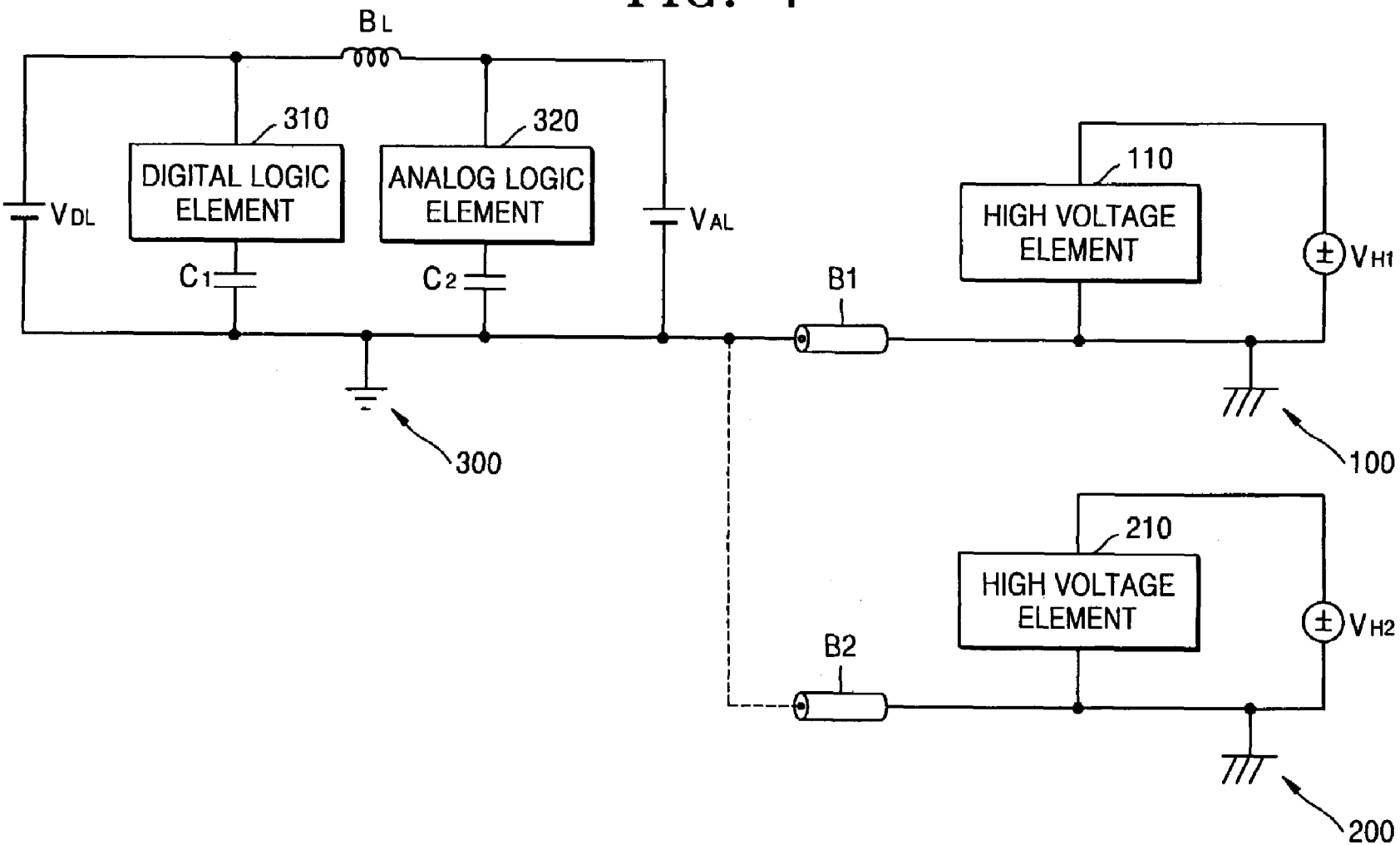
FIG. 7 is an equivalent circuit diagram of the noise reduction circuit of FIG. 6.

FIG. 7 is an equivalent circuit diagram of the noise reduction circuit of FIG. 6. A left circuit for the low voltage logic element includes the left low voltage logic element, the digital logic power source $V_{DL}$ for supplying a voltage to the digital logic element 310, the analog logic power source $V_{AL}$ for supplying a voltage to the analog logic element 320, and the inductor provided with the ferrite bead $B_L$ that is connected between the digital logic power source $V_{DL}$ and the analog logic power source $V_{AL}$. The ferrite bead $B_L$ has almost no DC loss and has a high impedance ranging from $10^2\Omega$ to $10^{10}\Omega$ with respect to only RF noise. Therefore, the ferrite bead $B_L$ greatly reduces the RF noise component but does not significantly influence the DC component, thereby eliminating noise. The eliminated noise is converted into heat energy within the ferrite bead $B_L$ and then consumed. A main ingredient of the ferrite bead $B_L$ is $Fe_2O_3$, NiO and ZnO and another auxiliary ingredient is CoO or MgO.

The capacitor C1 is connected between the digital logic power source $V_{DL}$ and the low voltage ground 300, and the capacitor C2 is connected between the analog logic power source $V_{AL}$ and the low voltage ground 300. In other words, a pair of the capacitors C1 and C2 are connected in parallel to the power sources $V_{DL}$ and $V_{AL}$ centering on the ferrite bead $B_L$. The ferrite bead $B_L$ and the pair of the capacitors C1 and C2 form a passive low-pass filter to block RF noise.

The EED according to the present invention has following effects.

First, the noise influence is reduced by indirectly separating the grounds among the high voltage elements and the low voltage elements, which can be mutually affected. In other words, the noise influence is reduced at the high voltage elements and the low voltage elements by connecting the ferrite bead B1 having a high impedance with respect to only RF components between the high voltage ground and the low voltage ground.

Second, the mutual noise influence between the high voltage elements is reduced by separately providing the high voltage grounds and connecting the ferrite beads $B_1$ and $B_2$ having a high impedance with respect to only RF component between each ground.

Third, with regard to the low voltage element, the digital logic element and the analog logic element use individual power sources and a common ground and include a π-type noise reduction circuit, thereby reducing the mutual noise influence between the low voltage elements. In other words, the logic elements that are the low voltage elements use a common ground, and the p-type noise reduction circuit is arranged between the digital logic power source and the analog logic power source, resulting in a reduction of the noise influence.

Although the first high voltage element 110 and the second high voltage element 210 are respectively assumed to be the data driver 18 and the anode 22, the high voltage elements can be one of the data driver, the scan driver, the cathode electrode lines, the gate electrode lines, and the anode. Specifically, although the above embodiments are described centering on the top-gate type EED, the present invention can be applied to under-gate type or mesh type EEDs.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. An Electron Emission Display (EED) comprising:

a high voltage terminal for a high voltage element;

a low voltage terminal for a low voltage element;

a ferrite bead, connected between the high voltage terminal and the low voltage terminal, to separate the high voltage terminal and the low voltage terminal into a high voltage ground and a low voltage ground, to block RF noise from the high voltage ground; and a plurality of capacitors respectively connected between a digital logic power source and the low voltage terminal and between an analog logic power source and the low voltage terminal, the ferrite bead and the capacitors adapted to function as a n-type noise reduction circuit;

the low voltage terminal is commonly connected to the digital logic power source for a digital logic element and analog logic power source for an analog logic element, and the ferrite bead is connected between the digital logic power source and the analog logic power source to mutually block noise from each other.

2. The EED of claim 1, further comprising:

a plurality of high voltage terminals respectively for a plurality of high voltage elements driven by different high voltages; and a plurality of ferrite beads respectively connected between the plurality of high voltage terminals.

3. The EED of claim 2, wherein at least one of the plurality of high voltage terminals is connected to an anode of an EED panel.

4. The EED of claim 2, wherein at least one of the plurality of high voltage terminals is connected to cathode electrode lines of an EED panel.

5. The EED of claim 2, wherein at least one of the plurality of high voltage terminals is connected to gate electrode lines of an EED panel.

6. The EED of claim 1, wherein the low voltage terminal is connected to a data driver adapted to output a data signal to an EED panel.

7. The EED of claim 1, wherein the low voltage terminal is connected to a scan driver adapted to output a scan signal to an EED panel.

8. The EED of claim 1, further comprising:

a plurality of high voltage terminals respectively for a plurality of high voltage elements driven by different high voltages; and a plurality of ferrite beads respectively connected between the plurality of high voltage terminals.

9. The EED of claim 8, wherein at least one of the plurality of high voltage terminals is connected to an anode of an EED panel.

10. The EED of claim 8, wherein at least one of the plurality of high voltage terminals is connected to cathode electrode lines of an EED panel.

11. The EED of claim 8, wherein at least one of the plurality of high voltage terminals is connected to gate electrode lines of an EED panel.

12. The EED of claim 1, further comprising:

a plurality of high voltage terminals respectively for a plurality of high voltage elements driven by different high voltages; and a plurality of ferrite beads respectively connected between the plurality of high voltage terminals.

13. The EED of claim 12, wherein at least one of the plurality of high voltage terminals is connected to an anode of an EED panel.

14. The EED of claim 12, wherein at least one of the plurality of high voltage terminals is connected to cathode electrode lines of an EED panel.

15. The EED of claim 12, wherein at least one of the plurality of high voltage terminals is connected to gate electrode lines of an EED panel.

16. An Electron Emission Display (EED), comprising:

a plurality of high voltage terminals respectively for a plurality of high voltage elements driven by different high voltages;

a terminal for a digital logic power source;

a terminal for an analog logic power source;

a low voltage terminal for a low voltage element connected in common to the terminal for the digital logic power source and the terminal for the analog logic power source;

a plurality of ferrite beads connected between the plurality of high voltage terminals; and a ferrite bead connected between each of the plurality of high voltage terminals and the low voltage terminals; and a π-type noise reduction circuit formed by the ferrite beads and a plurality of capacitors, the plurality of capacitors being respectively connected between the digital logic power source and the low voltage terminal and respectively connected between the analog logic power source and the low voltage terminal.

17. An Electron Emission Display (EED), comprising:

a high voltage terminal for a high voltage element;

a low voltage terminal for a low voltage element;

a ferrite bead, connected between the high voltage terminal and the low voltage terminal, to separate the high voltage terminal and the low voltage terminal into a high voltage ground and a low voltage ground, to block RF noise from the high voltage ground; and a π-type noise reduction circuit formed by the ferrite bead and a plurality of capacitors, the plurality of capacitors being respectively connected between the digital logic power source and the low voltage terminal and respectively connected between the analog logic power source and the low voltage terminal.

* * * * *